US005082132A

United States Patent [19]

Tsai

[11] Patent Number: 5,082,132

[45] Date of Patent: Jan. 21, 1992

[54] SANITARY TRASH BIN

[76] Inventor: Wei C. Tsai, Room 5, 2F, No. 80, Ho Ping West Road, Sec. 2, Taipei, Taiwan

[21] Appl. No.: 450,999

[22] Filed: Dec. 15, 1989

[51] Int. Cl.[5] ..... B65F 1/16; B65D 43/26

[52] U.S. Cl. ..... 220/23.83; 220/264; 220/315; 220/908; 248/147; 248/907

[58] Field of Search ..... 248/131, 147, 907; 232/43.1, 43.2; 220/1 T, 23.2, 23.4, 23.83, 23.86, 85 CH, 255, 262, 263, 264, 315, 346

[56] References Cited

U.S. PATENT DOCUMENTS

| | | | |
|---|---|---|---|
| Re. 30,875 | 3/1982 | Anderson | 220/262 |
| 1,580,880 | 4/1926 | Frisbie | 220/264 |
| 1,606,291 | 11/1926 | Burrows | 220/1 T |
| 2,736,454 | 2/1956 | McConnell | 220/23.2 |
| 2,759,625 | 8/1956 | Ritter | 220/262 |
| 2,811,329 | 10/1957 | Press et al. | 220/263 |
| 3,028,015 | 4/1962 | Williams | 248/147 |
| 3,208,706 | 9/1965 | Clark | 248/147 |
| 3,322,477 | 5/1967 | Armijo | 232/43.2 |
| 3,378,323 | 4/1968 | Goldberg | 248/147 |
| 3,388,856 | 6/1968 | Safford | 232/43.1 |
| 3,561,710 | 2/1971 | Cummings et al. | 248/147 |
| 3,666,135 | 5/1972 | Kindle | 220/263 |
| 3,836,037 | 9/1974 | Bass | 220/1 T |
| 3,904,218 | 9/1975 | Kostic | 220/23.4 |
| 4,191,297 | 3/1980 | Hardman | 248/147 |
| 4,331,074 | 5/1982 | Behman | 220/1 T |
| 4,860,909 | 8/1989 | Leumi | 248/907 |
| 4,892,218 | 1/1990 | Reiling | 220/1 T |

FOREIGN PATENT DOCUMENTS

| | | | |
|---|---|---|---|
| 1090977 | 12/1980 | Canada | 220/262 |
| 194339 | 9/1986 | European Pat. Off. | 220/1 T |
| 235233 | 4/1986 | Fed. Rep. of Germany | 220/1 T |
| 3516101 | 11/1986 | Fed. Rep. of Germany | 220/1 T |
| 2315437 | 1/1977 | France | 232/43.2 |
| 117531 | 8/1969 | Norway | 232/43.2 |

*Primary Examiner*—Stephen Marcus
*Assistant Examiner*—S. Castellano
*Attorney, Agent, or Firm*—Wenderoth, Lind & Ponack

[57] ABSTRACT

A double-barrel type sanitary trash bin having the two symmetrically arranged barrels disposed immediately on each side of a main container and a cross arm supported at the center on the apex of a piston rod and having the two ends attached at the lower sides to the upper sides of two barrel lids by suspension bars. A lid-operating mechanism comprises an air cylinder, a piston rod having at the lower end thereof a piston, an operating lever and a connecting rod and serves for the opening and closing of the lids. A further embodiment having no cylinder and piston is also disclosed.

12 Claims, 8 Drawing Sheets

Fig. 2B
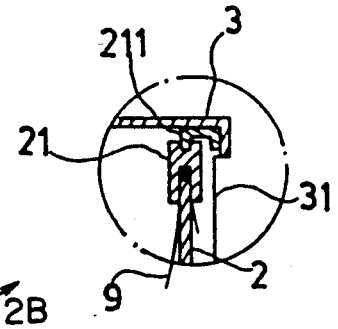
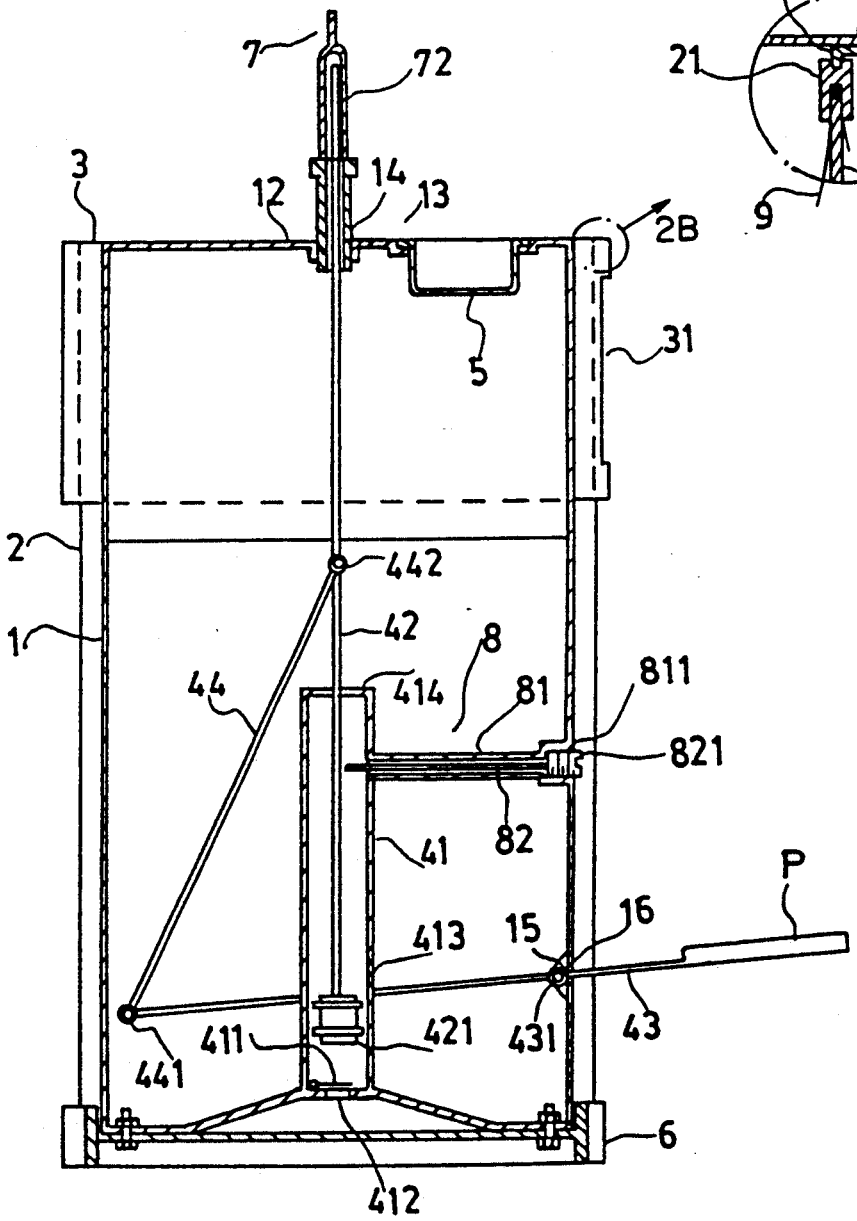
Fig. 2A

SANITARY TRASH BIN

BACKGROUND OF THE INVENTION

The present invention relates to a trash bin and, more particularly, to a double-barrel type sanitary trash bin the openings of which are normally concealed and are exposed for trash throwing only when the operating lever pedal is being stepped on and which is particularly adapted for collection of classified garbage.

It has been found that the conventional twin barrel-type public trash cans adapted for classified garbage are of an open type and as such, the site for these trash cans has been a place where foul smells spread easily, flies swarm about and garbage is left exposed to public view. This is extremely unhygienic and is also detrimental to the beauty of the city. On the other hand, where there are trash cans with lids, the cans are usually of the single-barrel type incapable of being used for classified garbage. Furthermore, with trash cans of the latter type there are two kinds of movable lids, one being of a pivotal or rotary type and the other of a lever operating type, for uncovering the trash throw-in openings of the cans. In the former kind, it always requires the user's hand to directly push open the cover plates along with the garbage to be thrown into the cans and, as such, it is not very convenient and it is also likely that the user's hand will come into contact with the cover or the can opening by accident. With the latter kind where the cover is opened by stepping on the lever pedal or the operating rod and the handling is somewhat more convenient, it still has the drawback of easily getting the user's hands dirty. In addition, there are problems such as an imperfect mechanism and lids frequently falling down creating a noisy disturbance. With these trash cans, moreover, a user's hand can accidentally be hit by the lids.

SUMMARY OF THE INVENTION

Accordingly, the object of the present invention is to eliminate the drawbacks of conventional trash cans and to provide a double-barrel type sanitary trash bin adapted for classified garbage, where the opening and closing of the bins can be done with precision and ease and where during the closing of the bin the lid drops down gradually and noiselessly and opening of the bin is normally concealed.

DESCRIPTION OF THE DRAWINGS

Other objects and advantages of the present invention shall become apparent from the following description of a preferred embodiment thereof in connection with the accompanying drawings, in which:

FIG. 2A is a sectional view of the trash bin taken along the line 2—2 of FIG. 1;

FIG. 2B is an enlargement of the lid structure of FIG. 2A;

FIG. 7C is an enlargement of the lid structure of FIG. 7A.

DETAILED DESCRIPTION OF THE PREFERRED EMBODIMENT

Figure 1B:
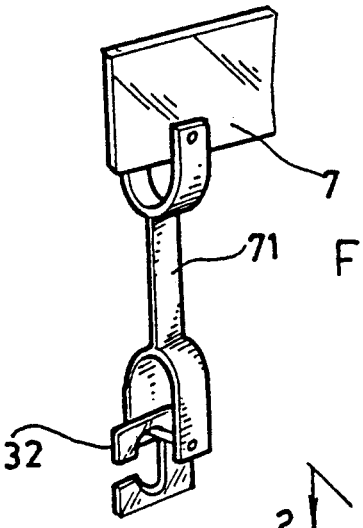
FIG. 1B is a perspective enlarged view of the suspension gear for connecting the barrel lids and the cross arm of FIG. 1A.
Figure 1A:
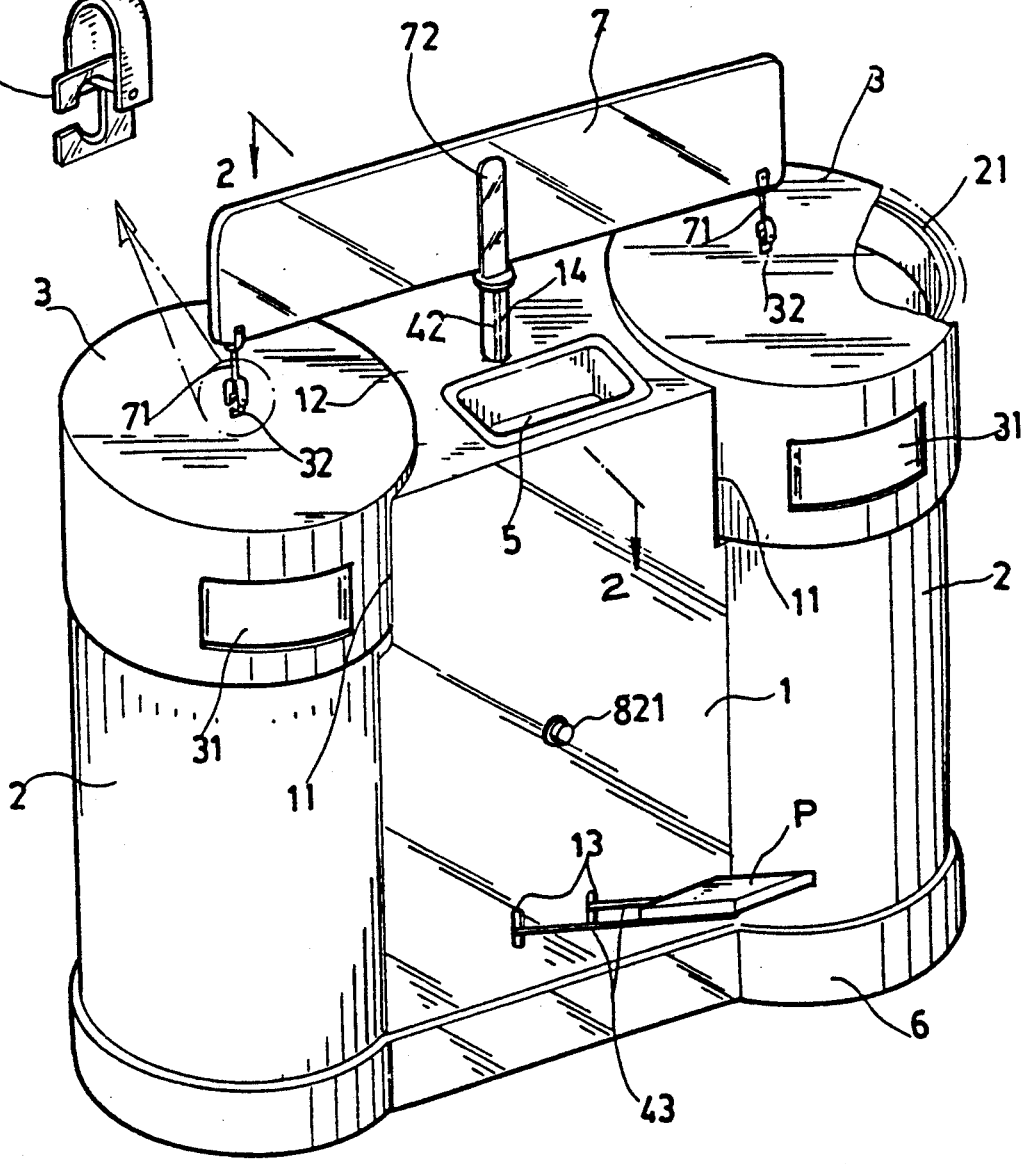
FIG. 1A is a partial sectional perspective view of a trash bin as constructed in accordance with the principle of the present invention.

Referring to FIGS. 1A, 1B and 2, there is shown a trash bin of the present invention comprising, essentially, a main housing 1, two symmetrically arranged barrels 2, 2 disposed respectively on each side of the main housing 1, two barrels 3, 3 placed respectively over the upper sides of the two barrels 2, a cross arm 7 disposed across the upper part of the two lids 3, a stop means 8, a lid operating mechanism 4 provided in and out of the main housing 1 and a base 6 for fixing thereto of the main housing 1 and for placement thereon of the two barrels 2. This base, however, may be deleted if the barrels 2 are integrally formed with the main housing 1.

The main housing 1 has a substantially box-like construction where the two side faces 11 are each formed of a shape which conforms to the outer circumferential wall of part of the barrels. The upper wall 12 of the main housing 1 is provided at a slightly central forward portion with a tray 5 for ashes and cinders.

This ash tray 5 is normally a removable type capable of being fitted in a receiving hole 13 and is thus easily removable for removal of ashes. However, the ash tray may also be of a fixed type or there may even be no ash tray provided.

The barrels 2 are separate from the main housing 1 and each is a bottomed cylindrical body attached to the end face 11 of the end of the main housing 1. For convenience in production, the two barrels 2 in the present embodiment are cylindrical in shape, although the barrels may also be of a rectangular or a polygonal shape or any other appropriate shape, and in the latter cases, the end faces 11 of the main housing 1 must be so configured that the shape will conform to the particular form of the barrels. Each of the barrels 2 is next provided around the opening at the upper end thereof with a sleeve member 21 for fixing thereto of a garbage plastic bag 9 (as shown in FIG. 2). The presence of a sleeve member, however, is optional. The lid 3 which is placed over the opening on the upper end of each barrel 2 is a structure formed to conform to the shape of the barrel 2 in section and is provided with at least one garbage throw-in opening 31. When the barrels 2 are covered with the lids 3, the openings 31 appear to be in a closed condition due to the fact that they are over the upper circumferential walls of the barrels 2, and only when the lids 3 have been lifted up to where the throw-in openings 31 are completely above the level of the top of the barrel walls will the throw-in openings 31 be in communication with the barrel openings and garbage can be thrown thereinto.

Figure 3:
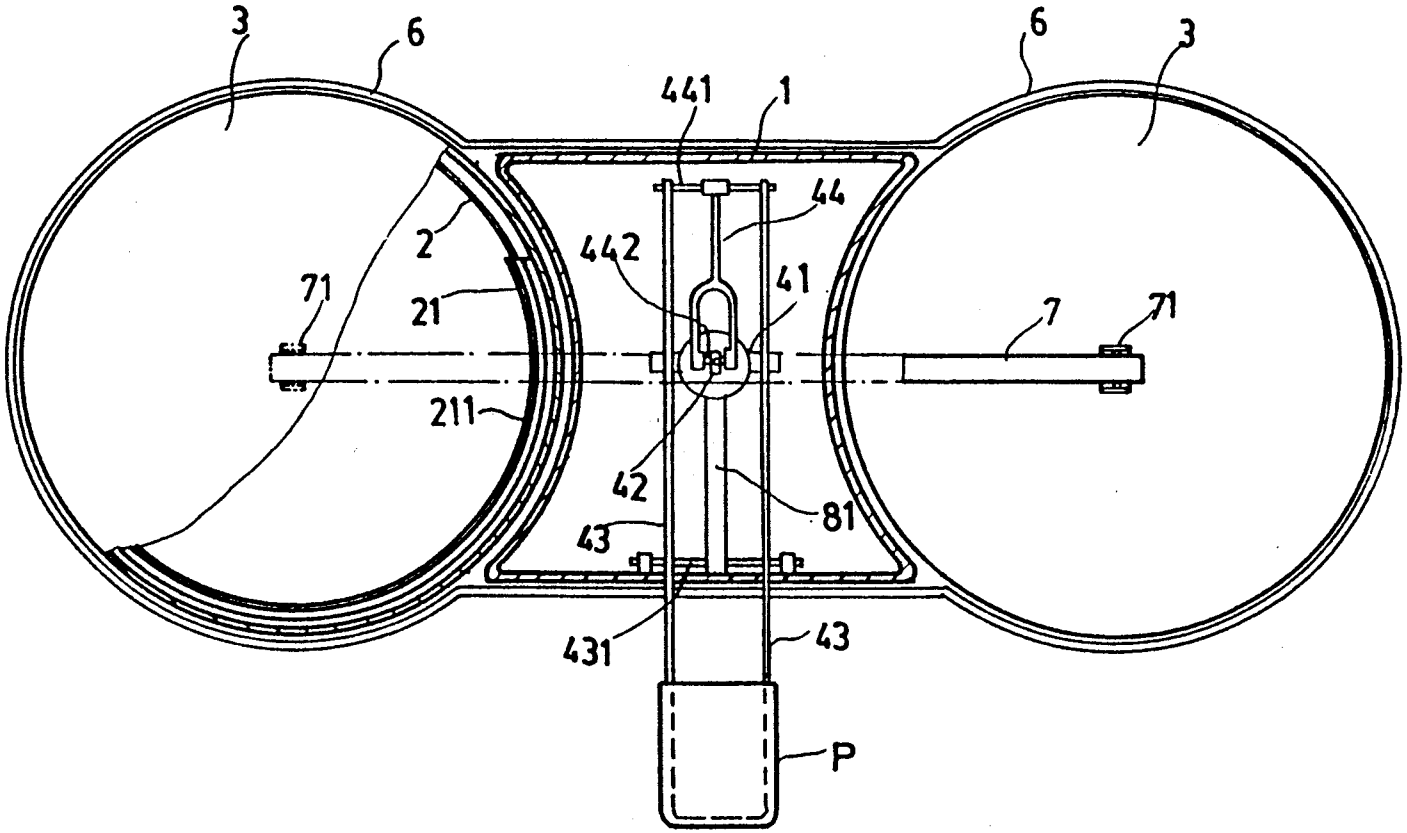
FIG. 3 is a partial sectional top view of the trash bin.

The lid operating mechanism 4, as shown in FIGS. 2 and 3, is a piston-connecting rod mechanism having the principal structure disposed inside the main housing 1 for opening and closing the lids. The mechanism 4 comprises an air cylinder 41, a lid lifting rod in the form of a piston rod 42, a piston 421, a U-shaped operating lever 43 and a Y-shaped connecting rod 44. The air cylinder 41 is vertically mounted on the bottom center inside the main housing 1 and includes at the bottom a unidirectional rubber valve 411 permitting air to be drawn in from the outside through an inlet opening 412 only and which will permit air from being released from the same opening, and in the lateral wall adjacent the middle part thereof is a smaller outlet opening 413 and on the upper end of the cylinder is a guide plate 414 for the piston rod. The piston rod 42 is inserted in the cylinder 41 by means of a piston 421 at the lower end thereof and is capable of sliding vertically in the cylinder. The U-shaped operating lever 43 is pivotally connected to a pivoting element 15 provided on the inner side of the front wall of the main housing 1 by a pivot shaft 431 and the curved end thereof extends outwardly through elongated slots 16 in the front wall of the main housing 1 and carries a pedal P, and the other end thereof extends towards the rear side wall of the housing. The operating lever 43 is articulated to the lid lifting rod 42 by a Y-shaped connecting rod 44 pivotally connected at the lower end thereof to the inner end of the operating lever 43 by a pivot shaft 441, and the upper end of which has a fork-shape and also pivotally connected to approximately the middle part of the piston rod 42.

The stop means 8 in this embodiment comprises an outside sleeve 81 and a stop lever 82 disposed inside the sleeve. The arrangement of the outside sleeve 81 is such that its outer end is located in the front wall of the main housing 1 and the inner end thereof is joined to the upper side wall of the cylinder 41 whereby the sleeve forms a support together with the cylinder. The stop lever 82 is inserted in the outside sleeve 81 with the inner end extending into the cylinder 41 and is retractable by a threading arrangement of a screw head 821 at the outer end and a screw nut 811 at the outer end of the outside sleeve 81.

The cross arm 7 is board-like and is supported at the center on the upper end of the piston rod 42 which extends out from the upper wall 12 of the main housing 1 and the cross arm 7 has the two ends attached respectively at the lower side to the upper sides of the two barrel lids 3 by a suspension bar 71.

The upper end of the piston rod 42 is inserted in the opening of a tubular member 72 on the cross arm 7 after it has passed through a short bushing 14 acting as a guide tube at the center of the upper wall 12 and extending inwardly. The two ends of the cross arm 7 are removably connected to the suspension hooks 32 by the double fork bars 71.

In the present embodiment, the barrels 2 are separable, i.e. the barrels can be easily removed for dumping of the garbage and for transportation. To achieve this object, each barrel 2 is provided at the bottom with a shallow disc-like base 6 which thus makes it possible that the two barrels 2 can be placed on the base to be close to either end of the main housing 1 which is fixed in position by screws to the base 6. Next, since the cross arm 7 is board-like and is inserted in position in the elongated sleeve tube of the tubular member 72 provided on the upper end of the piston rod 42, it is thus possible for the cross arm 7 to be maintained horizontally and also to function as a display board, for instance to place signs "for inflammables" and "for non-flammables". When the cross arm is not used for collection of classified garbage, it can be used as an advertisement board. It may also be appreciated that the two barrels 2 can be fixed to either end of the main housing 1 and together form a single body whereby the base 6 can be omitted.

In the following, a further embodiment of the trash bin of the present invention, wherein sleeve members 21 are provided on the mouths of the barrels but the lid operating mechanism has no cylinder, is described.

Figure 7A:
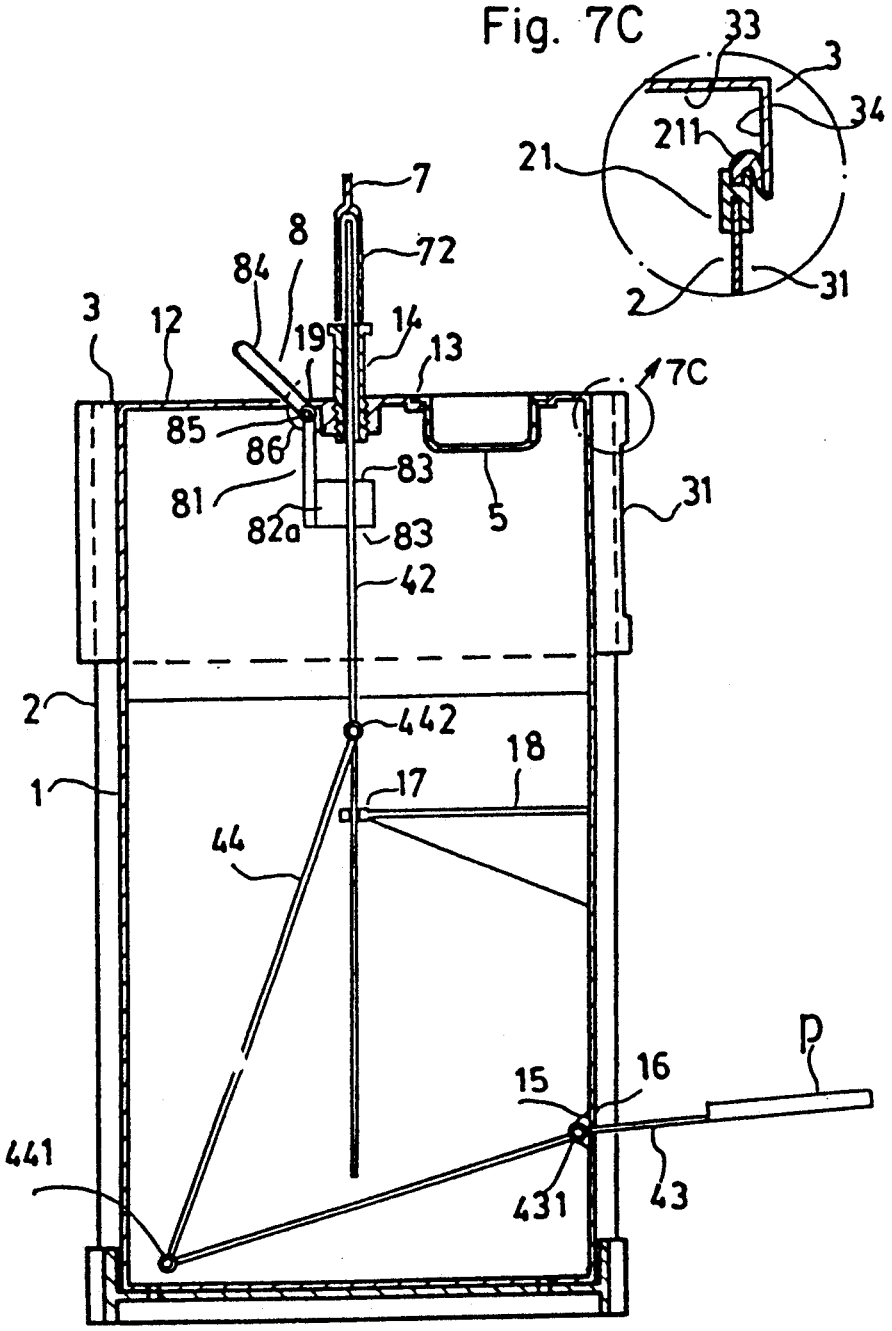
FIG. 7A is a section view of the trash bin in a further embodiment of the invention.
Figure 7B:
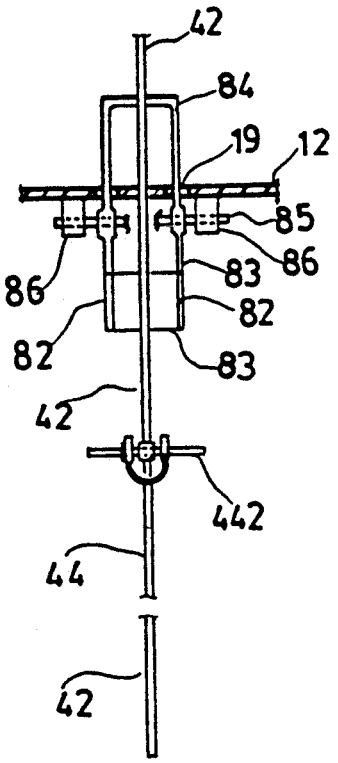
FIG. 7B is a side view showing the relative position of the check suspension gear and the pivot shaft on the upper end of the connecting rod of FIG. 7A.

As shown in FIGS. 7A and 7B, this further embodiment, except for the omission therein of a cylinder and a piston, and the provision of a different stop means from the stop lever 82, is the same in construction and operation as the first embodiment. The stop means is pivotally connected to a pivot element 86 by a shaft 85, and has a U-shaped handle 84 extending through a rectangular slot 19 in the upper wall 12 of the main housing 1 to extend outwardly from the latter. Two check plates **82*a* acting both as a stop and a suspension extend downwardly respectively from the two limbs of the handle 84 and are capable of movably retaining therebetween the lifting rod 42. Since the lifting rod 42 is the same as the piston rod of the first embodiment, this rod is pivotally connected at the center thereof to the forked upper end of the connecting rod 44 by a pivot shaft 442. When the pedal P is stepped on, the lifting rod 42 is pushed upward, and the upward movement stops when the pivot shaft 442 is blocked at the lower edges 83 of the two check plates 82, this position being equivalent to the one where the piston 421 of the first embodiment is blocked at the lower surface of the stop lever 82, shown in FIG. 4. After garbage has been thrown into the barrels and the foot has been removed from the pedal P, the lids start to descend. Because air will now escape from the barrels through the throw-in openings 31 which have not yet been closed, the descent is at first rapid, but when the lids have lowered to where the upper ends of the barrel bodies have closed the throw-in opening 31 and the air inside the barrels becomes compressed, and the descent of the lids 3 slows down. As in the first embodiment, in the second embodiment it is preferable, but not necessary, that each barrel mouth be provided with a sleeve member 21 and by close contact with the inner wall 34 on the lateral surface of the barrel lid of the elastic seal ring 211 of the sleeve member 21, a better sealing function is obtained. In this way, there will be no requirement for any restriction in the space between the barrel 2 and the lid 3. When it is necessary to replace a garbage bag inside the barrel 2, all that is required is to push the handle 84 of the stop means forward so as to turn the check plates 82 to the left, whereby the lifting rod is released so that the shaft 442 is free to rise. Thereafter, when pedal P is pressed to the ground and the user's hand releases the handle 84 and the foot is removed from the pedal, the shaft 442 will lie across the upper edges 83 of the plates. The position now is equivalent to the one where the piston 421 of the first embodiment is placed across the upper surface of the stop lever 82. As a result, the barrel lids 3** are stopped a certain distance above the upper barrel mouth to facilitate replacement of garbage bags, etc. For the other steps to be followed, it is the same in both embodiments and they will not be described again herein.

In the following, a method for using the trash barrels of the present invention is described.

Figure 4:
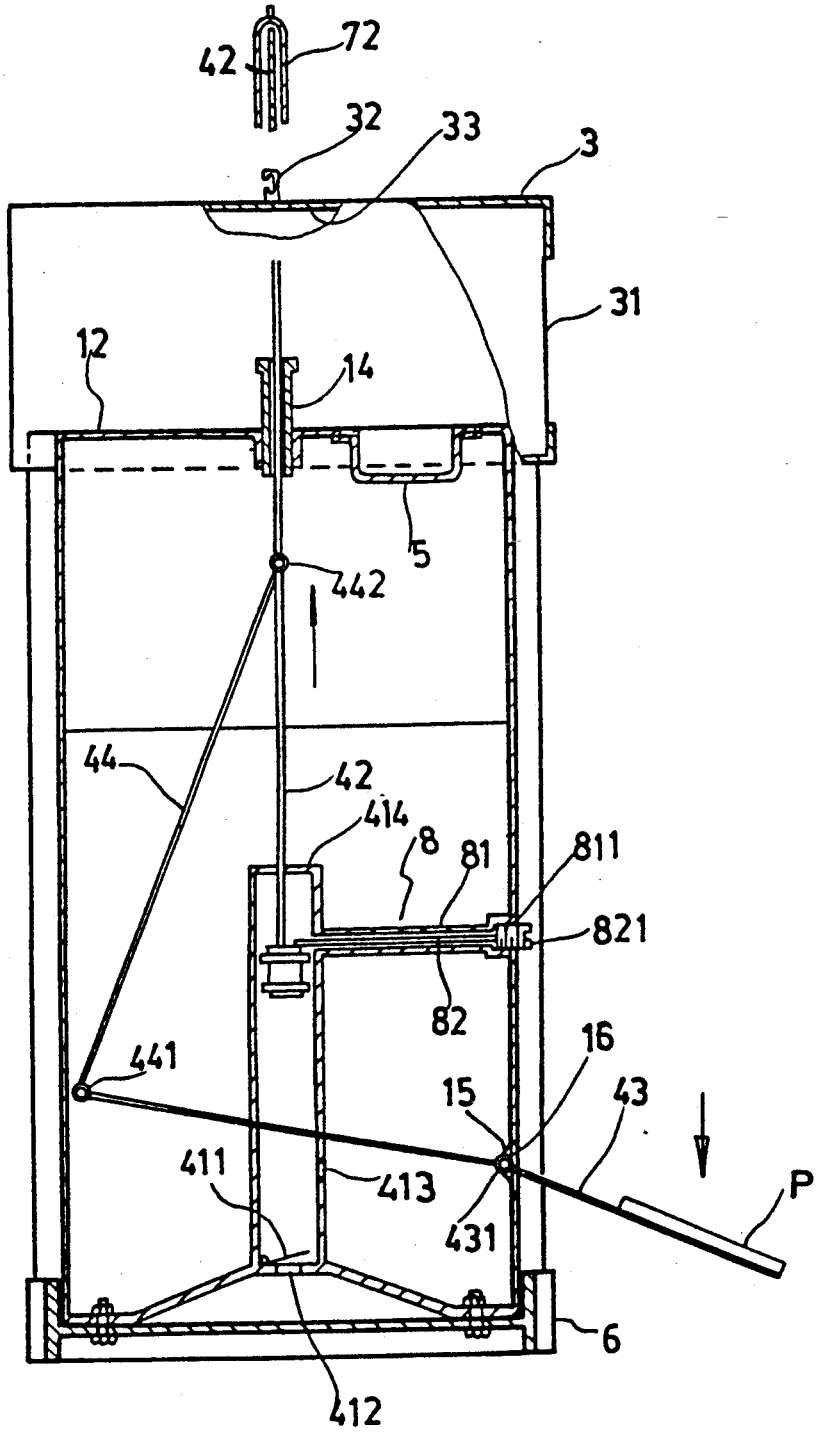
FIG. 4 is a sectional view of the trash bin corresponding to FIG. 2 showing opening of the bin for illustrating its operation.

Normally, openings of the barrels 2 are covered with the lids 3, and since the lids are removably connected to the cross arm 7 by the suspension bars 71, these lids 3 are under no restraint of the outside force and are thus capable of keeping in complete concord with the seal ring 211 of the sleeve member 21 thereby to seal up the barrel openings by their own weight. Furthermore, as the throw-in openings in the barrel lids 3 also appear to be closed, the entire interior of the trash barrels are thus kept in a sealed condition as shown in FIG. 2. When the pedal P is pressed down with a foot, from the position as shown in FIG. 2, the operating lever 43 with the pivot shaft 431 acting as fulcrum lifts up the connecting rod 44, which in turn pulls up the piston rod 42. At the same time, while the piston 421 draws air in through the inlet opening 412, the upper end of the piston rod 42 guided by the guide bushing 14 lifts up the cross arm 7 evenly by the tubular member 72. The two ends of the cross arm 7 in turn lift up the two barrel lids 3 by means of the suspension levers 71 until the pedal P has been pressed down to the end, and the upper side of the piston 421 is stopped at the inner end of the stop lever 82 when the lids 3 are raised to where the throw-in openings 31 are separated from the barrel walls and are in communication with the barrel openings. However, since the lower parts of the barrel lids are still in the position of embracing the barrels 2 as shown in FIG. 4, it makes it possible for the user to throw through the throw-in openings 31 any garbage and waste into respective barrels according to the classified symbols displayed in the cross arm 7. After the garbage and waste have been thrown into the barrels, a person only has to remove his foot from the pedal P and the lids, due to their own weight, will fall down gradually. In the beginning, because the inlet opening 412 is closed and air from inside the cylinder 41 is being expelled through the outlet opening 413 by piston 421, the falling speed of the lids 3 is faster. However, when piston 421 has lowered to the lower part of the outlet opening 413 and air is no longer expelled through said opening, there is formed an air cushion spring in the interior of the cylinder 41 below the outlet opening 413. Since there is no absolute air-tightness between the piston 421 and the cylinder 41, air that has been compressed in the cylinder will still escape gradually. Hence, even during the last part of the lowering, the lids 3 are still able to come down slowly until the barrel openings have been closed and the trash bin has returned to the original condition of FIG. 2.

Improved air-tightness may be obtained, however, by mounting a sleeve member 21 in the mouth of a barrel, which also acts to fix in place the lining of a plastic bag 9 in a barrel. This sleeve member 21 maintains air-tightness with the inside wall of the lid through the contact of the outer elastic sheet of the seal ring 211 inserted on the sleeve member and the inside of the barrel lid. In this way, not only is the reduction of the descending speed of the lids 3 even better, there is also the effectiveness of the seal ring 211 in keeping the barrel mouth air-tight when the lid 3 is replaced. In fact, this sleeve member 21 serves three purposes in one structure. Hence, even though the mounting of a seal ring 211 is optional, seal rings are nevertheless used in the present embodiment to avoid having to limit the space between the barrels 2 and the lids 3.

According to the present invention, there will never be the drawback that exists with conventional single barrel-type trash bins where when the foot is removed from the pedal, the barrel lid falls down rapidly, thereby hitting the barrel with a bang. Furthermore, since the pedal P, which is heavier than the sum total of the piston 421 but is lighter than the cross arm 7, is capable of pushing the piston rod 42 upward with a small force so that the piston rod will not fall to cause the upper end to be released from the tubular member 72. The cross arm 7 will come down, however, until it is supported on the guide bushing 14 fitted by threads to the upper side of the upper wall 12 of the main housing and is adjustable in relation to its height. With the help of the piston rod 42 inserted in the tubular member 72, this cross arm 7 is also capable of standing immobile.

Figure 5:
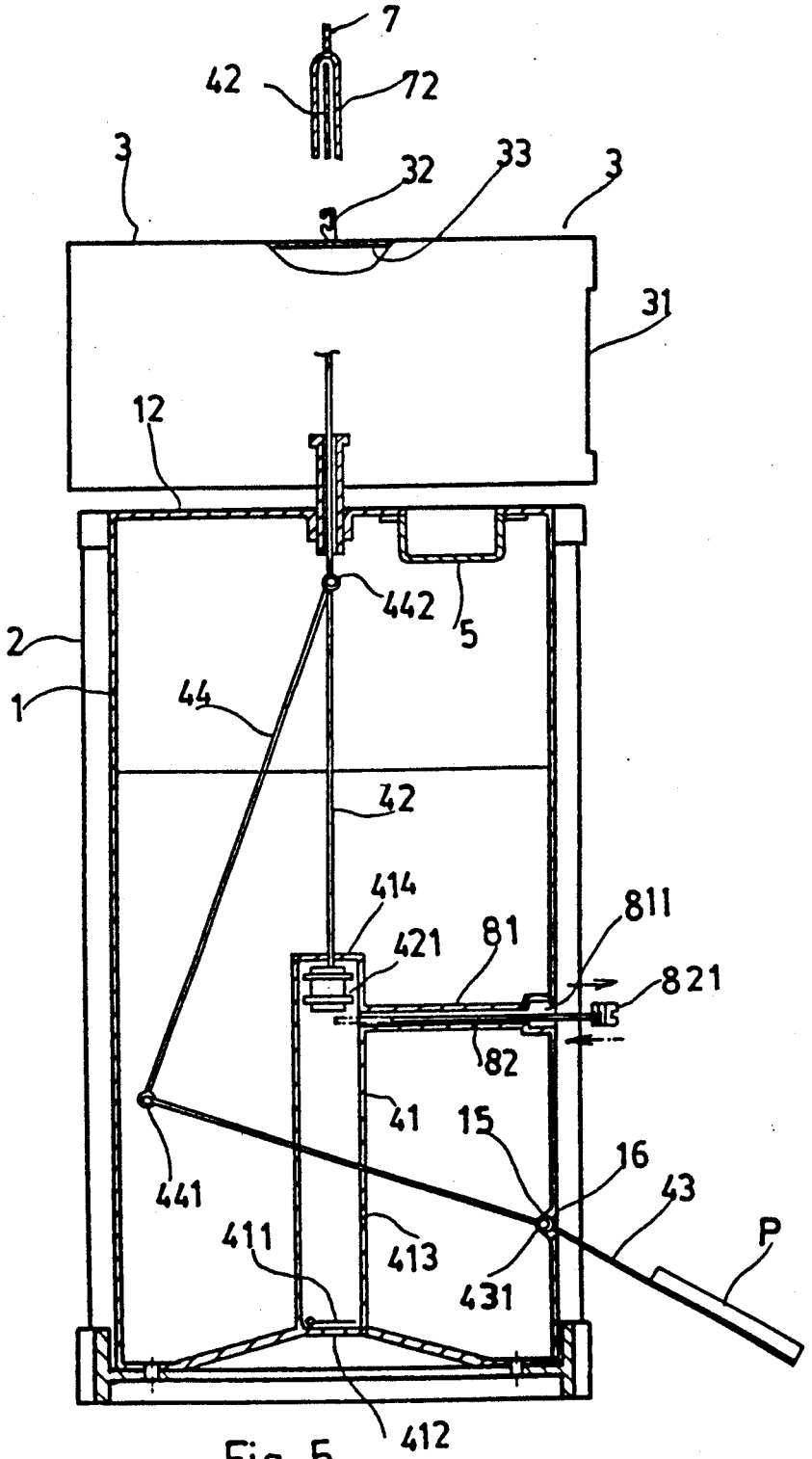
FIG. 5 is a sectional view where the bin cover has been raised to the maximum for illustrating operation.
Figure 6:
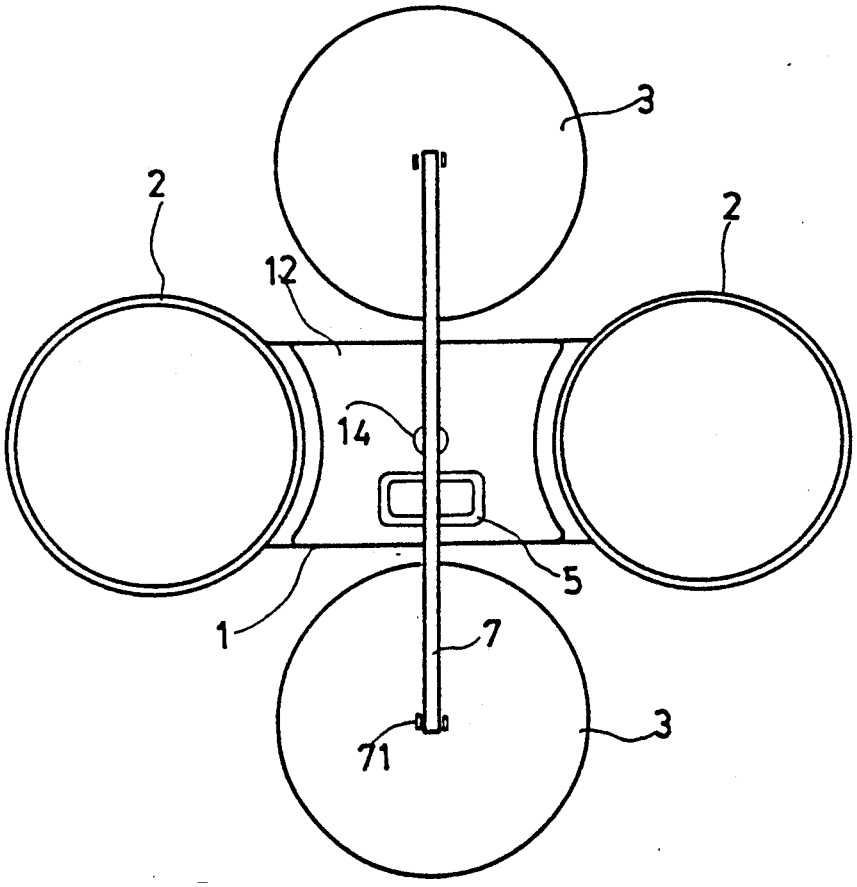
FIG. 6 is a top view of the trash bin where the bin cover has been turned 90° for replacement of a new disposable trash bag.

When it is desired to remove the garbage-filled plastic bags 9 from the barrels, whether in a separable or integrable type trash bin, all that is required is to first adjust the stop lever 82 until the front end has been completely retracted into the outside sleeve, and then press down the pedal P until it is touching the ground. At this time, the barrel lids 3 are lifted up by the lid operating mechanism 4 in accordance with the foregoing similar action. When the lower portions of the lids 3 have been completely separated from the openings of the barrels 2 by a small distance to the condition as shown in FIG. 5, the stop lever 82 is then inserted into its original position to hold the lids at that position. Now, by removing the foot to release the pedal P, the barrels can then be removed, and by releasing the sleeve members 21, replacement of clean plastic bags can easily be accomplished. However, if the barrels 2 are of the integral type and are not removable, all one has to do is to turn the barrel lids 3 together with the cross arm 7 90°, as shown in FIG. 6. Again, if the trash bin of the present invention is close to a wall such that it is not possible to turn the barrel lids and the cross arm 90°, in such a case it will not be necessary, from the beginning, to press down the pedal P, nor is it necessary to adjust the stop lever 82. All that one has to do is to lift the cross arm 7 together with the lids 3 directly from the upper end of the piston rod 42 to remove the lids from the barrel mouths. Alternatively, it may also be possible to first push the lower end of the suspension lever 71 off the hanging base 32 and then remove in sequence the cross arm 7 and the barrel lids 3, and thereafter to release the sleeve member 21. By following this procedure, it is now possible to easily remove the garbage bag and, after a clean bag has been substituted, to return the trash bin back to its original condition as shown in FIG. 2 by reversing the above procedure.

The relation between the barrel lids 3 having throw-in openings 31 and the barrels 2 is something like that between the cylinder 41 having an outlet opening 413 and the piston 421. As described above, since the cylinder is not required to be completely air-tight, such a relation between the cylinder and the piston may be appropriately applied to the one between the barrel lids and the barrels. If the gap between the lid and the barrel is appropriately restricted, and the gap between the upper edge of the throw-in opening and the top plate of the lid is slightly increased, and in place of the stop lever appropriate stop means is substituted, as shown in FIGS. 7A and 7B, the lids during the descending process will produce the same effect as with the cylinder.

Owing to the construction, as alluded to above, in the trash bin of the present invention the barrel lids normally seal off the openings of the trash barrels. After the pedal has been stepped on, even though the garbage throw-in openings are uncovered, the lower parts of the lids will still not separate from the barrel openings and will thus not expose the garbage inside the barrels, nor will they expose the trash bags that have been folded on the outer sides of the openings of the barrels. Furthermore, when garbage has been thrown in, the lids drop down at first at a relatively fast speed, but the speed of lowering slows down when the lids have almost completely closed the barrel mouths. The trash bin thus offers many advantages, such as prevention of foul smells and swarms of flies, being highly hygienic and easy to operate, and producing no noise during closure of the lids. The trash bin is thus novel and practical.

I claim:

1. A double barrel-type trash bin, comprising:

a substantially box-like main housing having end faces at opposite ends conforming to the shape of side faces of barrels and side faces extending between said end faces;

a pair of barrels disposed adjacent the two ends of said main housing, said barrels having upwardly facing openings in the top side and having side faces against said end faces;

a pair of barrel lids placed over the respective upwardly facing openings of said barrels and having depending walls extending in sliding relation down over the side face of the corresponding barrel and said depending walls each having a throw-in opening therein; and a lid operating mechanism for lifting said lids from said barrels and having a lid lifting rod means mounted in said housing and guided for vertical movement therein and having an upper end projecting out of the top of said housing, a cross-arm having the middle thereof supported on the upper end of said lid lifting rod and having said barrel lids suspended from end portions of said cross-arm, rod lifting means extending laterally out of a side face of said housing and articulated to said lid lifting rod means for raising said lid lifting rod means upwardly to lift said lids from said barrels, and stop means movable into and out of engagement with said lid lifting rod means for blocking lowering of said lids when said rod lifting means is no longer actuated.

2. A trash bin as claimed in claim 1 in which said lid operating mechanism said lid lifting rod means is a piston rod having a piston on the lower end thereof, and said mechanism further comprising a cylinder in said main housing in which said piston is slidable and which has an inlet valve in the bottom thereof and an outlet in the side thereof, and said stop means comprises an outside sleeve extending transversely between said cylinder and a wall of said main housing and opening into said cylinder, and a stop lever slidable in said outside sleeve between a position in which the end of said stop lever toward said cylinder projects into said cylinder to either block further upward movement of said piston so as to limit upward movement of said piston rod, or block downward movement of said piston so as to maintain said piston rod in the raised position, and a position in which said end of said stop lever is housed within said outside sleeve.

3. A trash bin as claimed in claim 1 in which said main housing has an upper wall and an ash tray in said upper wall.

4. A trash bin as claimed in claim 1 further comprising a base member on which said main housing is mounted and on which said barrels are placed.

5. A trash bin as claimed in claim 1 in which said rod lifting means comprises an operating lever having a fulcrum in a middle portion of the length thereof mounted on a wall of said main housing and said operating lever projecting through said wall and having a pedal on the free end thereof outside said main housing, and a connecting rod having one end pivotally connected to the end of said operating lever within said housing and having the other end pivotally connected to said lifting rod means, whereby said lifting rod means is lifted to raise said lids when said pedal is depressed.

6. A trash bin as claimed in claim 1 in which said main housing has an upper wall and a guide bushing in said upper wall through which said lifting rod means extends for guiding said lifting rod.

7. A trash bin as claimed in claim 1 in which said barrels are detachably engaged with the end faces of said main housing.

8. A trash bin as claimed in claim 1 in which said barrels are fixed to the end faces of said main housing.

9. A trash bin as claimed in claim 1 in which said barrels each have a sleeve member around the openings thereof for fixing a plastic bag to the barrel.

10. A trash bin as claimed in claim 1 in which said barrels have a cross-sectional shape taken from circular, square, rectangular or polygonal cross sections.

11. A trash bin as claimed in claim 1 in which said cross-arm has a downwardly open tubular portion at the middle thereon for mounting over the upper end of said lifting rod for removably mounting said cross-arm on said lifting rod.

12. A trash bin as claimed in claim 1 in which said stop means comprises stop rod means pivotally mounted on an upper wall of said main housing and having plate means projecting laterally from said stop rod means and said stop rod means being pivotable between a position in which said plate means are clear of said lifting rod means and a position in which said plate means can block further lifting movement of said lifting rod means and block lowering movement of said lifting rod means and handle means on said stop rod means for pivoting said stop rod means between said two positions.

* * * * *